United States Patent [19]

Cartier et al.

[11] 4,314,409

[45] Feb. 9, 1982

[54] AUTOMATIC LINT SCREEN CLEANER AND STORAGE SYSTEM FOR DRYER

[75] Inventors: Roger J. Cartier; Gordon J. Krolzick, both of Benton Township, Berrien County, Mich.

[73] Assignee: Whirlpool Corporation, Benton Harbor, Mich.

[21] Appl. No.: 119,194

[22] Filed: Feb. 6, 1980

[51] Int. Cl.[3] ..... F26B 11/04

[52] U.S. Cl. ..... 34/82; 34/85; 34/133; 55/296

[58] Field of Search ..... 34/82, 133, 85; 55/290, 55/295, 296

[56] References Cited

U.S. PATENT DOCUMENTS

| | | | |
|---|---|---|---|
| 2,594,456 | 4/1952 | Kroenlein . | |
| 2,611,192 | 9/1952 | Huebsch | 34/82 |
| 2,886,900 | 5/1959 | Flannery | 34/82 |
| 2,902,834 | 9/1959 | Bosworth, Jr. et al. . | |
| 4,140,503 | 2/1979 | Vandergriff | 55/295 |

*Primary Examiner*—Larry I. Schwartz

[57] ABSTRACT

Lint is automatically separated continuously from a dryer exhaust stream, rolled into string-like masses and released from a collecting screen where it is picked up by an auger conveyor and transported to a storage receptacle in compacted form.

17 Claims, 8 Drawing Figures

FIG. 4
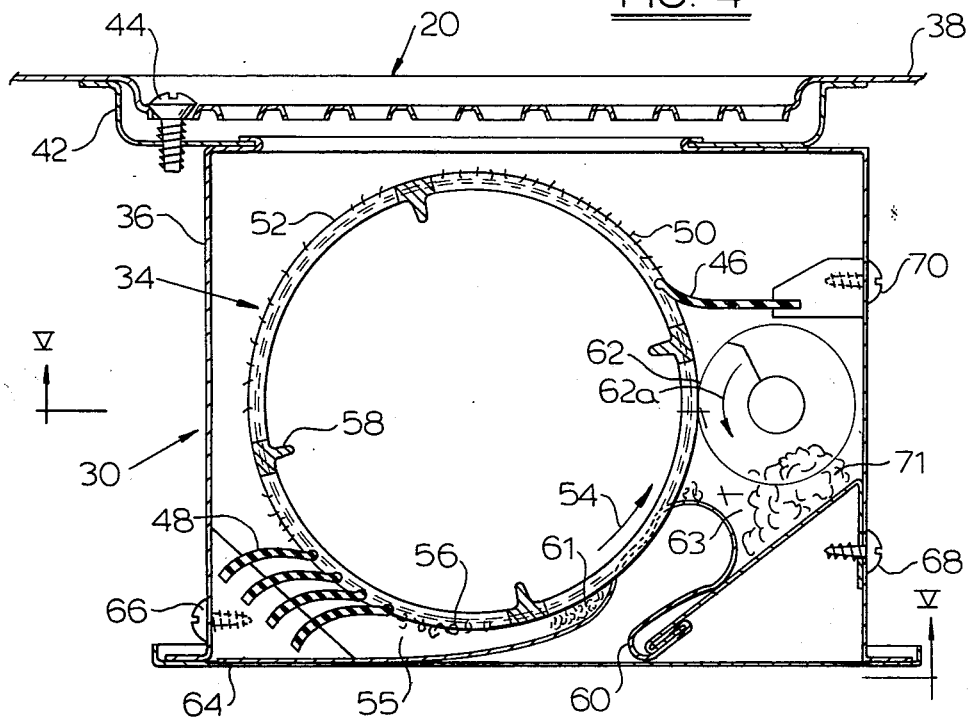
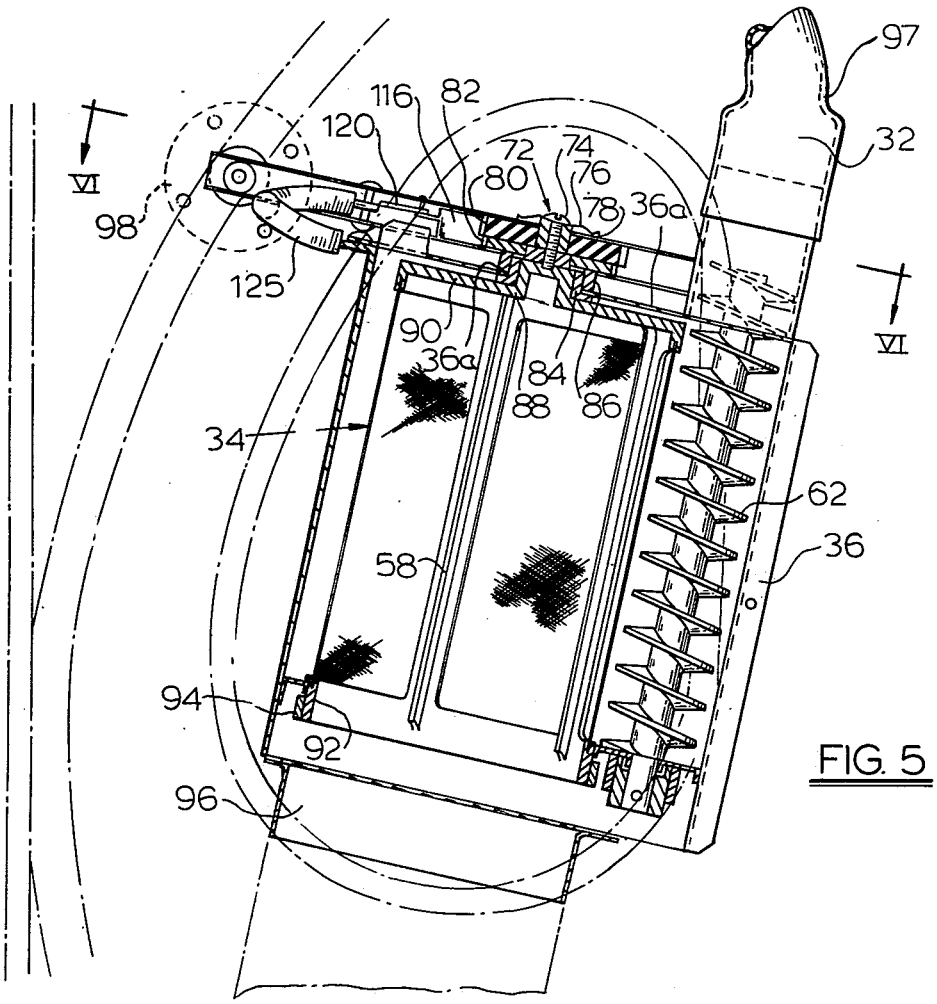
FIG. 5

AUTOMATIC LINT SCREEN CLEANER AND STORAGE SYSTEM FOR DRYER

BACKGROUND OF THE INVENTION

1. Field of the Invention

This invention relates to a means for cleaning a screen and more specifically to the automatic cleaning of a lint screen for use in an automatic clothes dryer.

2. Description of the Prior Art

A lint collector is disclosed in U.S. Pat. No. 2,886,900 issued to J. P. Flannery in which air passes from the inside to the outside of a stationary cylindrical screen and a rotatable auger driven by a ratchet mechanism from the rotating drum is provided within the cylinder to scrape the screen and move the uncompressed lint from the screen to a storage receptacle.

A moving screen cleaned by a stationary wiper within a vacuum cleaner is disclosed in U.S. Pat. No. 2,594,456 issued to H. A. Kroenlein.

A moving flat screen cleaned by a stationary wiper within an air conditioning apparatus is disclosed in U.S. Pat. No. 2,902,834 issued to C. M. Bosworth, Jr. and Raymond T. Divers.

Contemporary dryers generally have a lint handling system comprising a screen which is held stationary in a flow of exhaust air from the drum and which separates the lint from the air as it passes to the blower. The stationary lint screen must be removed at periodic intervals to be manually cleaned by the operator of the appliance.

SUMMARY OF THE INVENTION

The present invention provides a means of automatically separating the lint continuously from the dryer exhaust air system, rolling it into string-like masses and passing it to a transport system. The transport system moves the lint to a storage receptacle which is accessible through a hinged panel in the machine top and which requires cleaning only approximately every two years under average conditions of household use.

The invention comprises a rotating cylindrical screen through which the dryer exhaust is continuously passed from the outside of the cylinder to the inside of the cylinder and which includes multiple wiper blades to roll the lint deposited on the screen into string-like masses as the screen is advanced. The released lint is passed to a rotating auger to be transported to a smooth walled plastic tube and then to the storage receptacle in the upper right and upper left quadrant areas of the dryer cabinet.

DESCRIPTION OF THE DRAWINGS

FIG. 4 is a cross sectional plan view of the device embodying the present invention.

FIG. 5 is a cross sectional side view taken along line V—V of FIG. 4 including a partial section of the auger.

DESCRIPTION OF THE PREFERRED EMBODIMENTS

Figure 1:
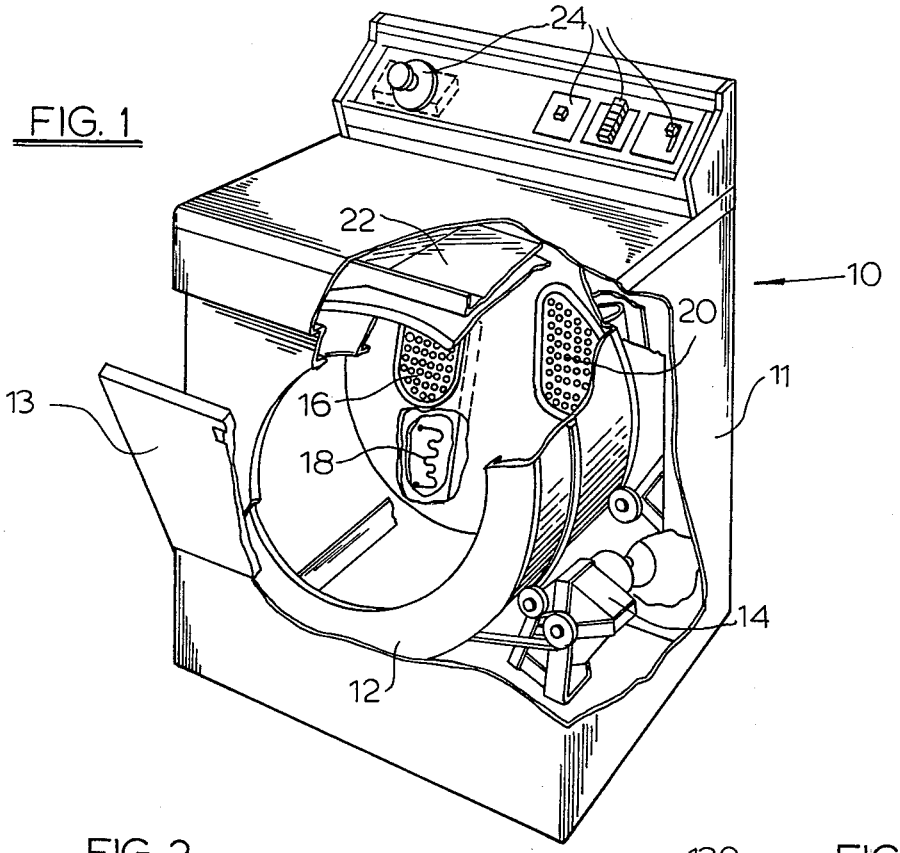
FIG. 1 is a perspective view of a dryer with a partial cut-away showing the electric motor, rotating drum, heater, air inlets and outlets, and a lint storage receptacle.

In FIG. 1 a clothes dryer is shown generally at 10 comprising a cabinet or housing 11, a rotating drum 12 for tumbling a clothes load, a door 13 to furnish access to the interior of the drum 12, an electrically driven motor 14 to rotate the drum 12, an air inlet 16 through which passes air heated by a heater 18 for use in drying the clothes load and which is discharged through an exhaust air opening or outlet 20, a blower means 26 (FIG. 2) for circulating the heated air through the clothes load, a lint collecting receptacle 22 and controls 24 for use in setting the desired temperature of the heated air and the length of time of the drying cycle.

In accordance with the principles of the present invention, it is contemplated there will be provided a means of automatically separating lint continuously from the dryer exhaust air stream, rolling it into string-like masses, releasing it from the intermittently rotating screen where it is picked up by a gear coupled auger to be transported through a smooth walled plastic tube to the storage receptacle mounted in the upper area of the cabinet. Service access is through a hinged panel in the machine top or through a hinged top, thereby providing approximately two years of storage capability for the accumulated and compacted lint under normal operating conditions of household use.

Figure 2:
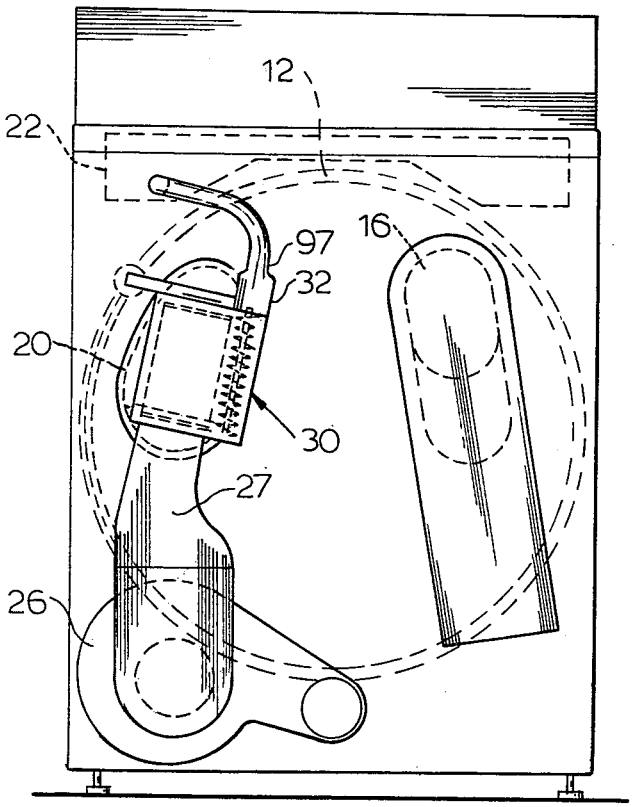
FIG. 2 is a back view of the dryer of FIG. 1 showing in phantom the storage receptacle, the rotating drum, the air inlet and air outlet and the device comprising the present invention.

Shown in phantom in FIG. 2 is the air inlet 16 and exhaust air outlet 20 and also the blower means 26 having an inlet 27 and a discharge port 28. An automatic lint screen cleaner and storage mechanism shown generally at 30 is provided between the exhaust air outlet 20 and the discharge port 28. A lint transport tube 32 connects the automatic lint screen cleaner and storage mechanism 30 to the lint collecting receptacle 22. A phantom view of the back side of the drum 12 is also shown.

The automatic lint screen cleaner and storage mechanism 30 is shown in detail in FIGS. 4 through 7. Referring specifically to FIG. 4, the mechanism 30 is comprised of a ratchet driven intermittently rotating lint screen 34 within a box frame assembly 36 which attaches to a bulkhead 38 of the dryer 10 at the bulkhead exhaust air opening 20. An adaptor pan 42 is provided to secure the box frame assembly 36 to the bulkhead 38 and is secured in place by a mounting means such as a slotted screw 44.

Lint laden air exits from the dryer drum 12 and flows through the exhaust air opening 20 entering the intermittently rotating cylindrical lint screen 34 from the outside between a cut-off blade 46 and a plurality of wiper blades 48 depositing lint particles 50 on an outer surface 52 of the lint screen 34. The filtered air continues through the screen and exits longitudinally for passage to the blower inlet 27 (FIG. 2). The lint screen 34 is rotated intermittently in a direction shown by arrow 54.

As the lint screen 34 rotates, the outer surface 52 containing lint particles 50 thereon comes in contact with the plurality of wiper blades 48 at a first collecting area 55. The blades 48, which are formed of an extruded elastometric material, are biased into intimate contact with the outer surface 52 of the lint screen 34 and thus roll and compact the lint 50 accumulated on the outer surface 52 into string-like masses 56 as the screen 34 rotates past the blades. The string-like masses 56 are moved around with the lint screen 34 by their adherence to the screen or by square edged longitudinal ribs 58 protruding beyond the circumference of the cylindrical screen 34. A folded sheet vinyl baffle 60 forms a tapered resilient collecting chamber 61 for collecting the lint masses 56 for movement by the longitudinal ribs 58 toward a lint passage means including a rotating auger 62 which is mounted parallel to and closely adjacent the lint screen 34 at a third collecting area 63. The lint collected in area 63 forms a larger lint mass 71 and the auger 62 transports and compacts the lint mass 71 from the collecting area 63.

A cover panel 64 is provided on the opposite side of the box frame assembly 36 from the exhaust air opening 20 to enclose the assembly. Each of the components, the wiper blades 48, the baffle 60, and the cut-off blade 46 is retained in place by mounting means such as screws 66, 68 and 70 respectively. The cut-off blade 46 is provided to ensure that the lint masses 56 which build up into the larger mass 71 do not get transported by rotation of the lint screen 34 to a point adjacent the bulkhead exhaust opening 20.

FIG. 5 is a cross sectional view showing the auger 62 and the lint screen 34. The lint screen 34 is rotatably retained within the box frame assembly 36 by a fastening means 72 comprising a retaining screw 74, a finger spring 76, and a flat thrust washer 78. Included in the fastening means is an idler ratchet wheel 80 and a drive ratchet wheel 82. The fastening assembly 72 rides on a bearing 84 held in place in an opening **36*b* in a top 36*a* of chamber 36 by a bearing retainer 86. The bearing 84 circumferentially abuts against a screen drive shaft 88 on a top closed portion or end 90 of the lint screen 34. A bottom open portion or end 92 of the lint screen 34 is provided with a rim gear 94 circumferentially on an outer surface thereof. A flanged discharge port 96 is provided to allow the filtered exhaust air to enter blower inlet 27 (FIG. 2**).

The auger 62 is rotatingly driven by the lint screen 34 and extends upward into the cylindrical lint transport tube 32 for removal of lint from the area of the lint screen 34. As the auger 62 moves the lint mass 71 (FIG. 4) towards the tube 32 it also compacts the lint into a smaller volume. The tube 32 has a necked-down portion 97 which serves to further compact the lint mass 71 before it reaches the lint storage receptacle 22.

Figure 6:
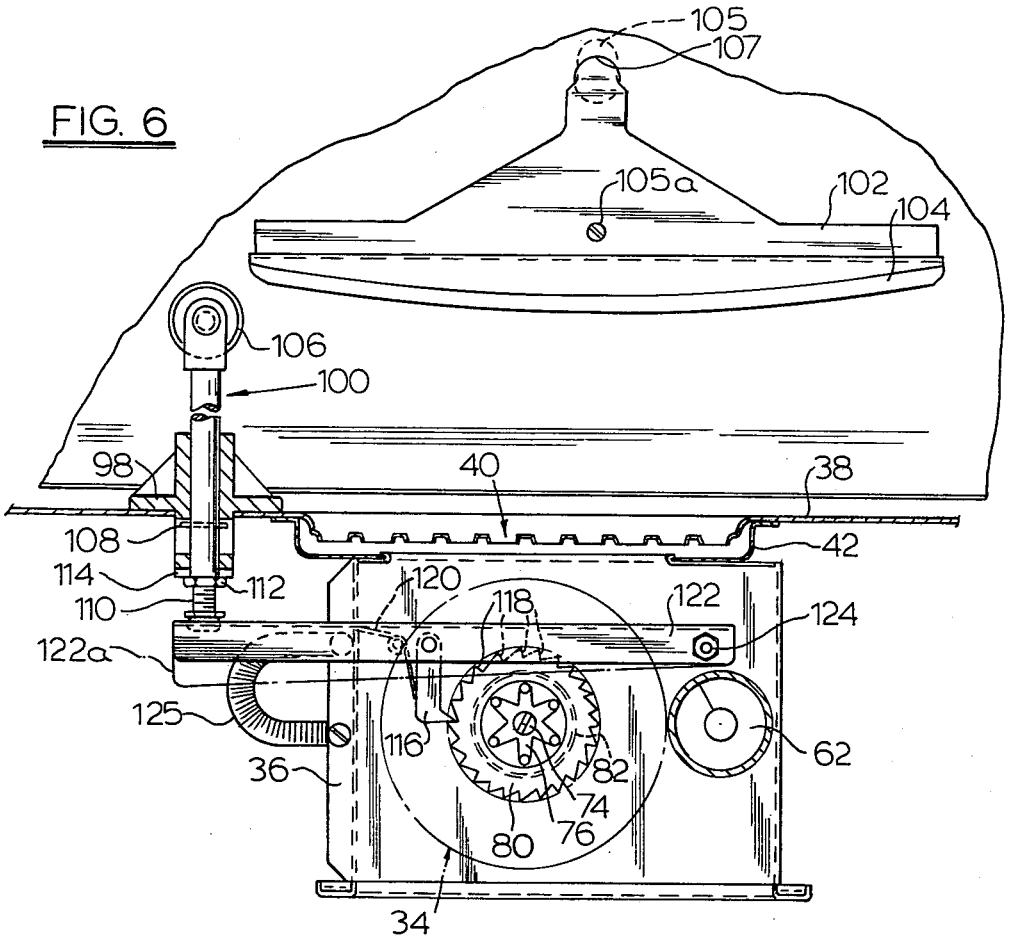
FIG. 6 is a partial cross sectional view of the dryer of FIG. 1 taken generally along lines VI—VI of FIG. 5.

A bulkhead mounted plunger guide 98 is provided as seen in FIG. 6. Retained within the plunger guide 98 is a follower assembly 100. The follower assembly 100 functions as a drive for intermittently rotating the lint screen 34. To perform this function, a formed sheet steel cam 102 with an extruded plastic cushion 104 adhesively bonded to the face of the cam 102 for noise reduction is attached to the circumference of the dryer drum 12. The cam 102 is attached parallel to the axis of rotation by fastening means, such as a slotted screw **105*a* and one off-set tab 105 tucked into a tooling hole 107 in drum 12. The cam 102 produces a reciprocating motion in a nylon roller cam follower 106 with each revolution of the dryer drum 12. The follower 106 is equipped with an anti-rotation cross-pin 108 to prevent the roller 106 from moving out of the plane of operation. An adjusting screw 110, jam nut 112, and a rubber stop 114 retain the follower assembly within the molded plunger guide 98**.

Figure 8:
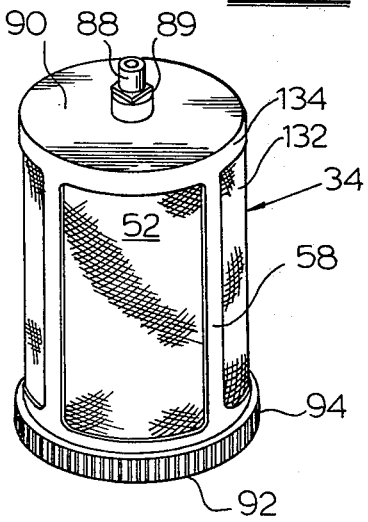
FIG. 8 is a perspective view of the lint screen collector.

Referring to FIGS. 5, 6 and 8, the follower 106 drives a dual ratchet mechanism consisting of the metallic, 36 tooth ratchet wheel 82, the 36 tooth rubber idler ratchet wheel 80 and a drive pawl 116. The drive ratchet 82 is installed on a square shoulder 89 (FIG. 8) of the screen drive shaft 88. The idler ratchet 80, with a root diameter slightly larger than the outside diameter of the drive ratchet 82, is mounted for rotation on the upper portion of screen drive shaft 88 and directly contacting the drive pawl 116. The idler ratchet 80 has six equally spaced deep cut teeth 118 (only four shown) which expose the drive ratchet 82 to contact with the drive pawl 116 each six revolutions of the dryer drum 12. The drive pawl 116 is biased against the idler ratchet 80 by means of a torsion spring 120. The drive pawl 116 is pivotally mounted on a channel type lever 122 which is shown in phantom at **122*a* in the position where the roller cam follower 106 is fully depressed by the rotating drum cam 102. The lever 122 is pivoted by means of a pin 124 which may be a bolt and nut assembly attached through the box frame assembly 36. The lever 122 stradles both ratchet wheels 80 and 82, and is biased into contact with the cam follower assembly 100 at an end opposite the pivot pin 124 by a spring means 125, for example a "Flexator" type, uniform rate return spring anchored between the box frame 36 and the lever 122**.

The drive pawl 116 thus incrementally rotates the lint screen 34 by one tooth on the drive ratchet 82 for each six revolutions of the dryer drum 12. The idler ratchet 80 and drive ratchet 82 may be replaced by a single drive ratchet wheel such that the cylindrical screen 34 is rotated the distance of one tooth of the ratchet wheel for each revolution of the dryer drum 12.

Figure 3:
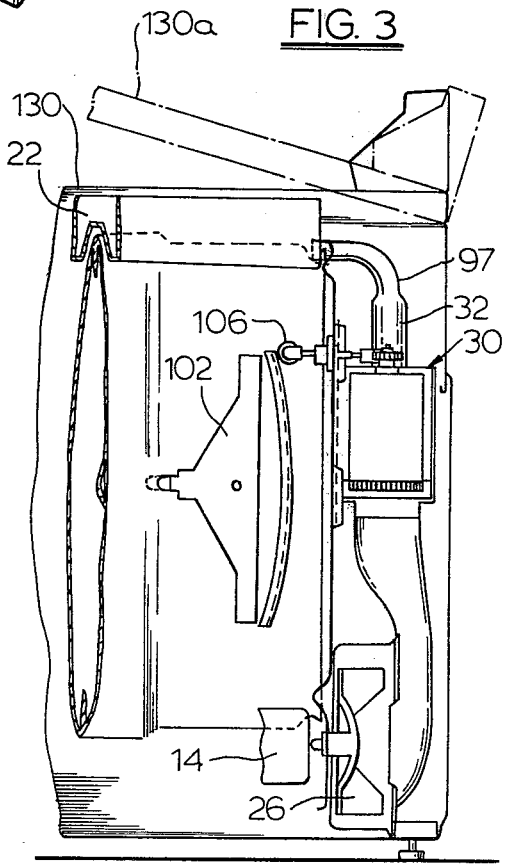
FIG. 3 is a cross sectional side view of the dryer in FIG. 1 showing the placement of the device of the present invention, and showing in phantom the manner in which the top is opened for access to the lint storage receptacle.
Figure 7:
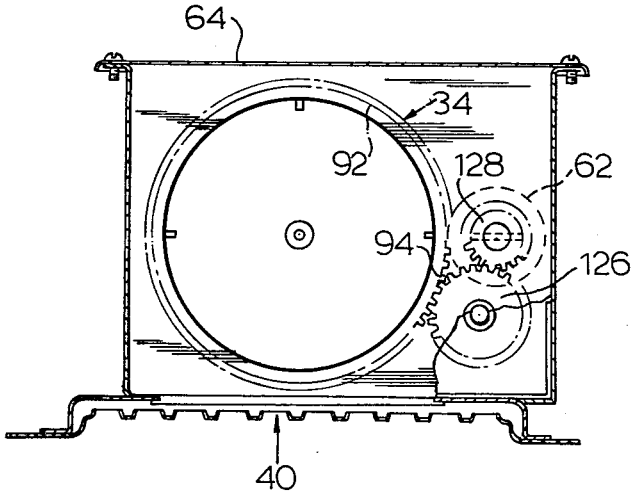
FIG. 7 is a bottom view of the device shown in FIGS. 4 and 5 showing the auger drive mechanism.

FIG. 7 shows the details of the gear coupled auger drive which comprises the rim gear 94 formed on the bottom portion 92 of the lint screen 34, an idler gear 126 and an auger drive gear 128 which is formed on the bottom of the auger 62, the teeth of the three gears 94, 126 and 128, being meshed such that rotation of rim gear 94 effects rotation of idler gear 126 which in turn effects rotation of auger drive gear 128. As seen in FIGS. 4 and 5, the auger 62 is thus coupled to the intermittently rotating lint screen 34 to rotate in the direction of arrow **62*a* to remove the lint accumulation 71 from the collecting area 63 to the storage receptacle 22 and in the process, compact the lint mass 71. The auger 62 is indexed rotationally about 40 degrees each time the ratchet mechanism moves the lint screen 34. The auger 62 advances and compacts the lint mass 71 through the plastic transport tube 32, which has the neck-down portion 97 to further compact the lint mass 71, to the light gauge steel storage receptacle 22 (FIGS. 2 and 3) mounted in the upper quadrants of the cabinet 11. Service access to the storage receptacle 22 is provided through a hinged panel (not shown) or a hinged top 130 as best seen in FIG. 3, where the top is also shown in a phantom view showing the raised position 130*a***.

As best seen in FIG. 8, the lint screen 34 comprises a galvanized wire cloth 132 preformed to a cylindrical shape and imbedded in a frame 134, injection molded with a plastic material such as nylon or polypropylene.

For example, a wire cloth blank is bias cut to size to prevent fraying, and is preformed to a cylindrical shape. For structural support, the integral rim gear 94 is molded at the open end 92 of the screen 34 and is intended to drive the auger 62. The square edged external ribs 58, in addition to acting as structural support for the frame 134, act as pushers to assist in causing the lint particles 50 accumulated on the screen 132 to be rolled into string-like masses 56 to be moved to collecting area 63 for pick-up by the auger 62. The closed end 90 of the lint screen 34 has the integral step drive shaft 88 with the square shoulder 89 to accommodate the drive ratchet wheel 82.

In summary, the dryer motor 14 rotates the drum 12 and circulates air therethrough. As the drum rotates the cam 102 produces a reciprocating motion in the cam follower 106. The follower 106 drives the dual ratchet mechanism comprising ratchet wheels 80 and 82 through the drive pawl 116. The lint screen 34 is thus incrementally rotated one increment for each six revolutions of the dryer drum 12. The incremental rotation of the screen 34 causes the rim gear 94 formed on the bottom portion 92 of lint screen 34 to drive the auger drive gear 128 through the idler gear 126. The auger 62 is thus indexed rotationally each time the ratchet mechanism moves the lint screen 34. The lint laden air exiting from the dryer drum 12 enters the intermittently rotating cylindrical lint screen 34 and deposits lint particles 50 on the outer surface 52 of the lint screen 34. Filtered air flows through the screen and exits longitudinally passing through the blower to be discharged from the dryer. As the lint screen 34 rotates, the outer surface containing the lint particles 50 comes in contact with the wiper blades 48. The lint 50 is rolled and compacted as the screen 34 rotates past the blades. The folded sheet baffle 60 forms a collection chamber 61 for collecting the string-like lint masses 56 for movement by the longitudinal ribs 58 to the collecting area 63 adjacent the rotating auger 62. The auger 62 advances the lint mass 71 through the plastic transport tube 32 further compacting the lint mass 71. The lint is transported to the storage receptacle 22 where service access is provided by the hinged top 130 of the dryer 10.

As is apparent from the foregoing specification, the invention is susceptible of being embodied with various alterations and modifications which may differ particularly from those that have been described in the preceeding specification and description. It should be understood that we wish to embody within the scope of the patent warranted hereon all such modifications as reasonably and properly come within the scope of our contribution to the art.

The embodiments of the invention in which an exclusive property or privilege is claimed are defined as follows:

1. In a dryer having a drum for tumbling a clothes load and a blower means for circulating heated air through said clothes load to an air flow passage, an automatic lint screen cleaner and storage mechanism for separating lint from said circulating air, said mechanism comprising:

a cylindrical rotating lint screen in said air flow passage for collecting lint carried by said air on an outer surface of said lint screen;

a stationary wiper means mounted adjacent to and in frictional contact with said outer surface for separating said collected lint from said screen; and lint passage means surrounding a portion of said screen for directing said separated lint to a storage container, said lint passage means including a compression means for compressing said lint to require a smaller volume for storage and a transport tube connecting said compression means to said storage container.

2. In a clothes dryer, an improved mechanism for automatically separating lint continuously from an exhaust air stream, said mechanism comprising:

a cylindrical rotatable filter screen through which the exhaust air stream is directed from an outside of the cylinder to an inside of the cylinder so that lint separated from the exhaust stream is deposited on an outside surface of the cylinder filter screen;

drive means for intermittently rotating the filter screen;

wiper means engaging said outside surface of said filter screen to roll and compact the deposited lint accumulation into masses that are readily separable from the filter screen outside surface;

an auger mounted closely adjacent said screen to separate and collect the lint from the outside surface and to transport the lint masses away from the filter screen;

a smooth wall conduit receiving the lint masses from the auger; and means forming a collector zone into which the conduit delivers the collected lint masses.

3. In a clothes dryer as defined in claim 2, said wiper means comprising a plurality of elastometric wiper blades.

4. In a clothes dryer as defined in claim 3, said screen having a plurality of circumferentially spaced square edged longitudinal ribs working in conjunction with said wiper blades to move said lint to said auger.

5. In a clothes dryer as defined in claim 4, and further characterized by a folded sheet-form baffle forming a tapered resilient chamber for urging the accumulated lint into closer contact with the auger.

6. In a clothes dryer as defined in claim 2 including a drum driven in rotation for tumbling a clothes load wherein said drive means comprises:

a toothed ratchet wheel corotatably connected to said screen;

a cam follower plunger engageable with said wheel to drive said ratchet wheel upon reciprocating motion thereof; and a cam adapted to rotate with said dryer drum and engageable with said cam follower plunger to reciprocate said plunger with each revolution of the dryer drum, whereby the screen will be incrementally rotated upon rotation of said drum.

7. A clothes dryer having an automatic lint screen cleaner and storage mechanism, said clothes dryer comprising:

means forming a treatment zone in which clothes are dried;

an air inlet through which a stream of temperature conditioned air is admitted into said zone;

an air outlet through which a stream of lint laden air is discharged from said zone;

a cylindrical rotatable lint screen positioned to receive and pass the lint laden stream from an outside of the screen to an inside of said screen;

whereby lint separated from the stream of air is deposited on said outside of said screen, a stationary wiper means mounted adjacent to and in frictional contact with said outside of said lint screen for separating said lint from said screen upon relative movement therebetween, additional means for enhancing the separation of said lint from said screen and more particularly comprising a folded resilient sheet form member forming with an adjacent exterior surface of said lint screen a tapered collecting chamber for collecting lint masses separated from said screen by said stationary wiper means, means for selectively rotatably driving said screen; and a means for collecting and transporting the removed lint to a location remote from said screen.

8. In a clothes dryer defined in claim 7, including a rotatable drum for tumbling a clothes load, an automatic lint screen cleaner and storage mechanism having a cylindrical rotatable lint screen and having a drive means for intermittently rotating said lint screen, said drive means comprising:

a toothed ratchet wheel means corotatably connected to said screen;

a cam follower plunger engageable with said ratchet wheel to drive said ratchet wheel upon reciprocating motion thereof; and a cam adapted to rotate with said dryer drum and engageable with said cam follower plunger to reciprocate said plunger with each revolution of said dryer drum, whereby said screen will be incrementally rotated upon operation of said dryer.

9. In an automatic lint screen cleaner and storage mechanism of claim 8, said toothed ratchet wheel means comprising:

a drive ratchet having a given outside diameter;

an idler ratchet having a root diameter slightly larger than said outside diameter of said drive ratchet, said idler ratchet having at least one deep cut ratchet tooth on said idler wheel and being of a number less than the total number of ratchet teeth on said idler ratchet; and said idler ratchet and said drive ratchet being in juxtaposition, whereby said idler ratchet is rotated more frequently than said drive ratchet.

10. In a clothes dryer defined in claim 7, said rotatable screen comprising a plurality of circumferentially spaced longitudinally extending ribs which resiliently engage said sheet form member and assist in advancing the lint masses towards a lint passage means.

11. In a clothes dryer defined in claim 7, and auger means for moving the lint out of the lint passage means.

12. In a dryer having a drum for tumbling a clothes load and a blower means for circulating heated air through said clothes load to an air flow passage, an automatic lint screen cleaner and storage mechanism for separating lint from said circulating air, said mechanism comprising:

an air inlet means connected to said air flow passage;

a cylindrical rotating lint screen in said air flow passage for collecting lint carried by said air on an outer surface thereof;

stationary wiper means mounted adjacent to and in frictional contact with said outer surface for separating said collected lint from said screen;

a plurality of equidistantly spaced ribs carried on said outer surface of said rotating lint screen for moving said separated lint with said rotating screen;

a resilient baffle means located rotationally behind said stationary wiper means for urging said separated collected lint towards a lint collection area;

an auger means located rotationally behind said baffle means for transporting and compacting said separated lint from said collection area;

a cut-off wiper means located rotationally behind said auger means providing a lint barrier;

a ratchet drive means driven by said dryer drum for rotating said lint screen;

a gear coupling means interconnected between said lint screen and said auger for driving said auger upon rotation of said lint screen;

a lint storage receptacle having a hinged access door to permit a user of the dryer to periodically remove lint from said receptacle; and a lint transport tube one end of which surrounds said auger, the other end of which is attached to said lint storage receptacle.

13. The device of claim 12 wherein said lint transport tube has a necked-down portion which serves to further compact said lint before it reaches said lint storage receptacle.

14. An automatic lint screen cleaner and storage mechanism comprising:

a cylindrical rotating lint screen;

a stationary means for automatically removing lint from said screen;

a remote lint storage receptacle; and a means for transporting said removed lint to said remote storage receptacle;

said transporting means including a first means for partially compacting said removed lint and a second means comprising a transport tube having a necked-down portion for further compacting said partially compacted lint.

15. An automatic lint screen cleaner and storage mechanism comprising:

a box frame assembly forming a lint-collecting zone through which a stream of lint-laden air is directed, a cylindrical lint screen in said box frame assembly for intercepting said stream of lint-laden air and operable to separate the lint from the stream of air so that the lint is collected on the surface of said screen, a lint storage receptacle exterior of said box frame assembly, an elongated lint transport tube communicating with said lint collecting zone and having a lint-collecting area extending generally adjacent said lint screen in said box frame assembly, scraper means engageable with said lint screen for automatically removing lint from said screen and directing the lint into said lint-collecting area, a transporting means in said lint-collecting area movable relative to said tube to advance and partially compact removed lint collected in said collecting area into said lint transport tube, said lint transport tube having a necked-down portion to further compact said lint and being connected to said lint storage receptacle for disposing of the lint exteriorly of the lint collecting zone.

16. An automatic lint screen cleaner and storage mechanism as defined in claim 15 wherein said transporting means comprises an auger having helical blades extending into said lint transport tube at said lint collecting area and operable upon rotation relative to said tube to advance the lint through the tube for discharge into the storage receptacle.

17. An automatic lint screen cleaner and storage mechanism as defined in claim 16 wherein said lint screen is mounted for rotation and including a drive train rotationally interconnecting said auger and said lint screen whereby said auger is rotated as a function of the rotation of said lint screen.

* * * * *